United States Patent [19]

Yoshida et al.

[11] 4,254,539

[45] Mar. 10, 1981

[54] SLIDE FASTENER STRINGER

[75] Inventors: Hiroshi Yoshida, Uozu; Shunji Akashi, Kurobe, both of Japan

[73] Assignee: Yoshida Kogyo K K, Tokyo, Japan

[21] Appl. No.: 105,292

[22] Filed: Dec. 19, 1979

Related U.S. Application Data

[63] Continuation of Ser. No. 903,189, May 5, 1978, abandoned.

[30] Foreign Application Priority Data

May 10, 1977 [JP] Japan ..... 52-53297

[51] Int. Cl.[3] ..... A44B 19/00

[52] U.S. Cl. ..... 24/205.11 F; 24/205.16 C

[58] Field of Search ..... 24/205.11 F, 205.16 R, 24/205.16 C, 205 R

[56] References Cited

U.S. PATENT DOCUMENTS

| | | | |
|---|---|---|---|
| 3,333,305 | 8/1967 | Taylor | 24/205.11 F |
| 3,533,140 | 10/1970 | Waldes | 24/205 R |
| 3,874,036 | 4/1975 | Yoshikawa | 24/205.16 C |

FOREIGN PATENT DOCUMENTS

| | | | |
|---|---|---|---|
| 2065711 | 2/1975 | Fed. Rep. of Germany | 24/205 R |

*Primary Examiner*—Kenneth Dorner

*Attorney, Agent, or Firm*—Bucknam and Archer

[57] ABSTRACT

A slide fastener stringer comprises a stringer tape including thermoplastic synthetic fibers and a row of continuous fastener elements made of thermoplastic synthetic resin and fixed by sewing threads to one longitudinal edge of the tape, the elements being reinforced by a braid extending along the element row. The slide fastener stringer has a cut edge where the tape, extreme one of the fastener elements, sewing threads, and braid are united together by fusing the tape and the extreme fastener elements against reveling of the cut ends of the tape, sewing threads, and braid, and against sticking up of the element from the tape. The cut edge has a substantially flat surface slanted with respect to the plane of the stringer tape, thereby giving the cut edge a neat and smooth appearance with no burrs thereon.

1 Claim, 5 Drawing Figures

SLIDE FASTENER STRINGER

This is a continuation of application Ser. No. 903,189, filed May 5, 1978, now abandoned.

BACKGROUND OF THE INVENTION

1. Field of the Invention

The present invention relates to a slide fastener stringer having a row of continuous fastener elements made of thermoplastic synthetic resin.

2. Prior Art

As is well known in the art, a row of filamentary fastener elements is attached to one longitudinal edge of an elongate slide fastener stringer by means of sewing threads. Such elongate fastener stringer is cut off into desired lengths each having an element-free gap through which a slider is to be assembled.

The stringer tape is prone to become raveled where it has been severed conventionally by a cutter, and the sewing threads which are broken by the cutter near the element-free gap allow fastener elements to loosen and come off. This has led to a drawback in that a slider cannot easily be attached, and the loosened fastener elements can prevent top and bottom end stops from being applied thereto at precise locations.

Various attempts have been made to eliminate the problems. One such effort is a plastic film bonded around the cut edges of the tape and fastener elements. It has also been proposed to impregnate the stringer tape with a synthetic resin solution, or to fuse thermoplastic material in the fastener components at the cut edges. Such prior procedures, however, are disadvantageous in that extra process steps are involved and in that the fastener elements once loosened cannot be properly restored to the fixed position. Furthermore, since the fastener stringer is cut substantially at a right angle to its general plane, the thermoplastic material upon solidification tends to create sharp cut edges which are injurious to the skin or the garments.

SUMMARY OF THE INVENTION

According to the present invention, a slide fastener stringer has a cut edge where an extreme fastener element, a stringer tape, both including thermoplastic synthetic resin material, sewing threads, and a reinforcing braid are united tightly together by fusing the element and the tape against raveling of the cut ends of the sewing threads, stringer tape and reinforcing braid, and against sticking up of the element from the tape. The cut edge has a substantially flat surface slanted with respect to the plane of the stringer tape, thereby giving the cut edge a neat and smooth appearance with no burrs thereon.

An object of the present invention is to provide a slide fastener stringer having fastener elements stabilized at the cut edge portions of the stringer against loosening therefrom.

Another object of the present invention is to provide a slide fastener stringer with its tape fabric and sewing threads held against raveling at the cut edge of the stringer.

Still another object of the present invention is to provide a slide fastener stringer having no burrs formed upon solidification of thermoplastic material at the cut edges of the stringer.

A further object of the present invention is to provide a pair of slide fastener stringers to which a slider, a top and a bottom end stop can be attached easily and precisely.

A still further object of the present invention is to provide a slide fastener stringer having reveling-free and stabilized cut edges that can be formed simultaneously with an operation in which the fastener stringer is cut off and is provided with element-free gaps.

The above and other objects and advantages of the present invention will become apparent from the following detailed description when taken in conjunction with the accompanying drawings.

DETAILED DESCRIPTION

Figure 1:
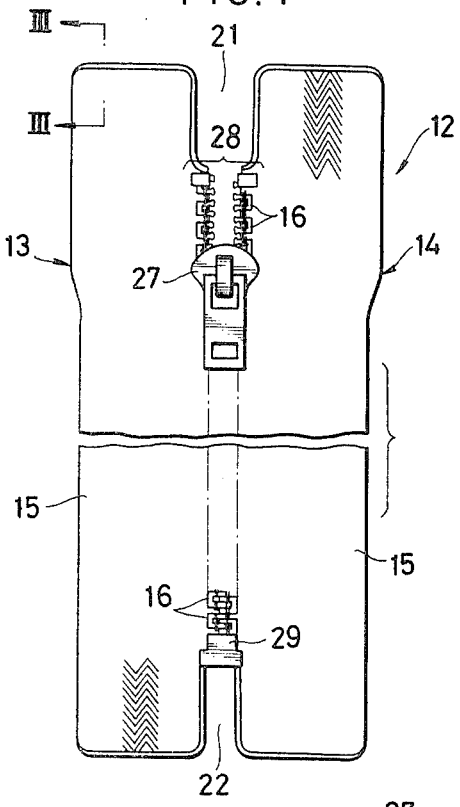
FIG. 1 is a plan view of a slide fastener comprising a pair of fastener stringers constructed according to the invention.

As shown in FIG. 1, a slide fastener 12 comprises a pair of fastener stringers 13,14 each including a stringer tape 15 and a row of continuous fastener elements 16 of the meandering or zigzag type mounted on and along one longitudinal marginal edge of the tape 15. The stringer tape 15 is of a woven or knitted structure including yarns of naturally occurring fibers blended with thermoplastic synthetic resin fibers, or solely with synthetic resin fibers. The tape 15 may alternatively be of a union fabric including naturally occurring fibers and thermoplastic resin fibers.

Each fastener element 16 includes a pair of upper and lower legs 17,18 (FIG. 4), the fastener elements 16 being disposed astride the stringer tape 15 with their upper and lower legs 17,18 respectively on the opposite surfaces of the tape 15. An elongate reinforcing member 19 such as a braid extends along the row of fastener elements 16 and is disposed on one side of the lower legs 18 of the elements 16 which is remote from the stringer tape 15.

Figure 2:
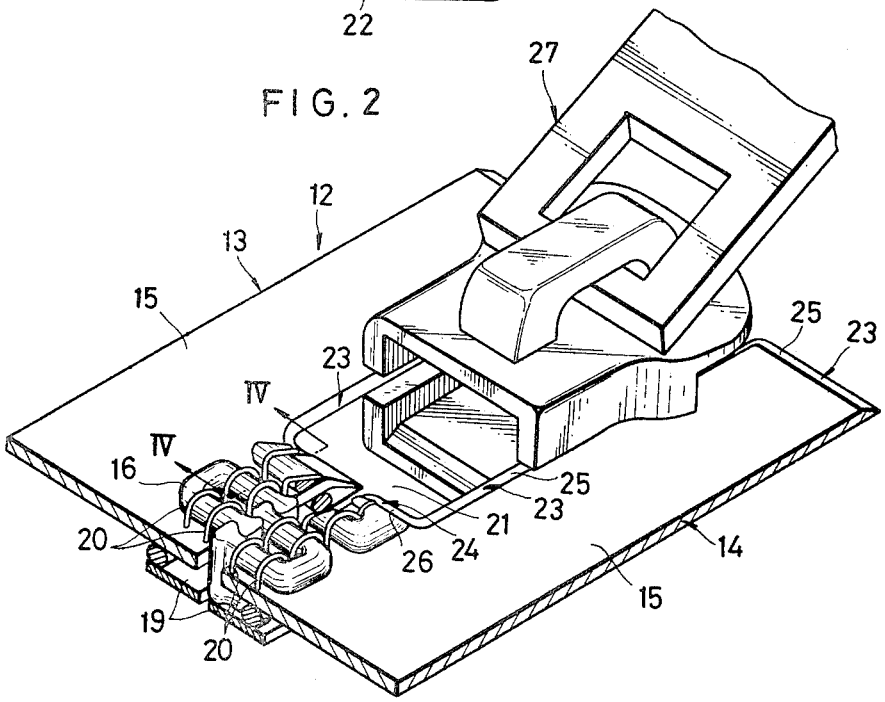
FIG. 2 is a fragmentary enlarged perspective view of the fastener shown in FIG. 1.
Figure 4:
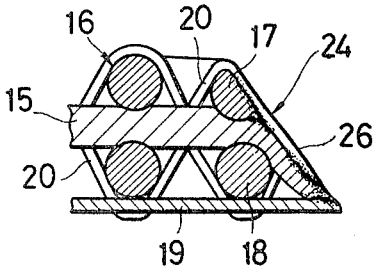
FIG. 4 is an enlarged cross-sectional view taken along line IV—IV of FIG. 2.

As better illustrated in FIGS. 2 and 4, the row of fastener elements 16 and the braid 19 are fixed to the stringer tape 15 by means of sewing threads 20 extending around the upper and lower legs 17,18 and penetrating the stringer tape 15 and the braid 19 thereby holding the fastener elements 16 in position on the stringer tape 15.

The pair of fastener stringer 13,14 with the element rows intermeshed is cut off from a continuous elongate blank of paired stringers (not shown), and at the same time are provided with an upper element-free gap or space 21 in its upper end portion and a lower element-free gap or space 22 in its lower end portion, the element-free gaps 21,22 being formed typically by stamping out the stringers 13,14. The cutting and stamping-out operation on the fastener stringer 13,14 is carried out by means of a punch (not shown) with heat generated as by a high-frequency or an ultrasonic welder, or an electric heater, so as to enable the edges and ends of the tapes 15,15 and fastener element 16 to be melted and fused simultaneously with the cutting and stamping-out operation, the cut edges and ends on solidification preventing reveling of the tape fabric yarns, sewing threads and braid yarns, and sticking up of the fastener elements 16 from the stringer tapes 15,15.

Figure 3:
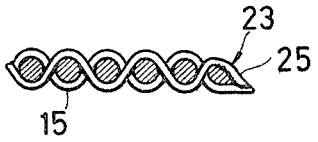
FIG. 3 is an enlarged cross-sectional view taken along line III—III of FIG. 1.

FIGS. 2, 3 and 4 show cut edges 23,24 that are neatly finished by fusing thermoplastic synthetic resin contained in the stringer tapes 15 and the fastener elements 16. The cut edge 23 is disposed solely in each stringer tape 15 and extends transversely and longitudinally thereof. The cut edge 24 is disposed in the longitudinal marginal edge portion of each stringer tape 15 on which the fastener elements 16 are mounted, the cut edge 24 extending transversely of the stringer tape 15. The cut edges 23,24 have substantially flat surfaces 25,26, respectively, slanted with respect to the plane of the stringer tape 15. Such slanted cut surfaces 25,26 are formed by a punch (not shown) having conplementary slanted surfaces that can be pressed with heat against the cut edges 23,24 when the fastener stringers 13,14 are cut off and element-free gaps 21,22 are produced by the punch.

As shown in FIG. 3, the slanted cut edge 23 of the stringer tape 15 includes fused fabric yarns, some of which are kept taut at the surface 25 by the corresponding slanted punch surface.

FIG. 4 illustrates extreme one of the fastener elements 16, the upper leg 17 of which is fused with the sewing threads 20 therearound extending under tension toward the braid 19 which is located remotely fromt the upper leg 17. The stringer tape 15 extends around the lower leg 18 of the extreme element away from the upper leg 17 toward the braid 19, the portion of the stringer tape 15 which extends beyond the lower leg 18 being disposed substantially parallel to the tensioned sewing threads 20 and being fused therewith at the slanted surface 26. The distal ends of the sewing threads 20 and stringer tape 15 are united integrally with the braid 19 against raveling. With the cut edge 24 thus shaped and fused, the extreme fastener element 16 is held securely in position by the tightened sewing threads 20 at the slanted edge surface 26. Such slanted cut edge 24 provides a guide surface which is relatively wide and is free of burrs, thereby allowing a slider 27 (FIGS. 1 and 2) to be attached smoothly into the stringers 13,14. In addition, when the fastener is attached to a garment, such gradually inclined cut edges are not harmful to the skin or other materials which might get in contact with such edges.

The slider 25 (FIGS. 1 and 2) is furnished onto the pair of fastener stringers 13,14 through the upper element-free gap 21 bounded by the neatly finished cut edges of the stringers 13,14. A top end stop 28 including a pair of stop halves and a bottom end stop 29, both made of synthetic resin, are formed on the upper and lower end portions, respectively, of the stringers 13,14, thereby confining the slider 25 for movement along the rows of fastener elements 16 between the top end stop 28 and the bottom end stop 29. With the extreme fastener elements 16 adjacent to the cut edges 24 stably positioned on the stringer tapes 15, the top and bottom end stops 28 and 29 can be molded thereon easily and precisely.

Figure 5:
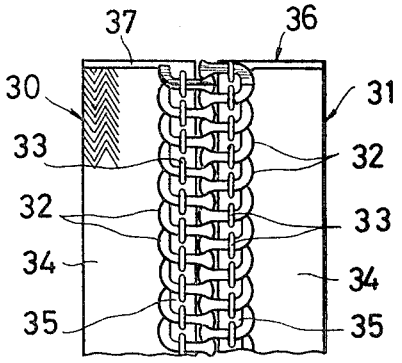
FIG. 5 is a fragmentary plan view of a pair of slide fastener stringers according to a modified form of the invention.

In FIG. 5, a pair of slide fastener stringers 30,31 each include a row of helically coiled fastener elements 32 sewn with threads 33 to one longitudinal edge of a fastener stringer tape 34, the fastener elements 32 being positionally stabilized by means of a reinforcing member such as a filling core 35 extending through the row of coiled fastener elements 32. The fastener stringers 30,31 have a transverse cut edge 36 which is fused and has a slanted surface 37 as with the embodiment shown in FIGS. 1 through 4.

It should be understood that the specific forms of the invention herein shown and described are intended to be illustrative only, as certain changes may be made therein without departing from the scope of the appended claims.

We claim as our invention:

1. A slide fastener stringer comprising:

(a) a stringer tape including thermoplastic synthetic fibers;

(b) a row of continuous fastener elements of the zigzag type made of thermoplastic synthetic resin and mounted on and along one longitudinal edge of said stringer tape, each of said fastener elements including an upper leg and lower leg;

(c) reinforcing means extending along said row of continuous fastener elements and being disposed on one side of said lower legs of the elements which is remote from the stringer tape; and (d) sewing threads fixing said fastener elements and said reinforcing means to said stringer tape, there being a cut edge in which the upper leg of a terminal one of said fastener elements is fused with said sewing thread therearound extending under tension toward said reinforcing means which is located remotely from said terminal upper leg, said stringer tape extending around and beyond the lower leg of said terminal one of fastener elements away from said last-named upper leg toward the reinforcing means, the portion of the stringer tape which extends beyond said last-named lower leg being disposed substantially parallel to said tensioned sewing thread, said stringer tape, said reinforcing means, and said tensioned sewing threads jointly hold said terminal one of said fastener elements in a fixed position are are integrally fused together therewith, and the distal ends of the sewing threads and stringer tape are united integrally with the reinforcing means, and said cut edge extending transversely of the stringer tape and having a substantially flat surface slanted with respect to the plane of said stringer tape.

* * * * *